US012588760B2

(12) United States Patent
Martinez

(10) Patent No.: US 12,588,760 B2
(45) Date of Patent: Mar. 31, 2026

(54) ANTI-TIP SYSTEM FOR FURNITURE

(71) Applicant: Michael Anthony Martinez, San Francisco, CA (US)

(72) Inventor: Michael Anthony Martinez, San Francisco, CA (US)

( * ) Notice: Subject to any disclaimer, the term of this patent is extended or adjusted under 35 U.S.C. 154(b) by 79 days.

(21) Appl. No.: 18/675,077

(22) Filed: May 27, 2024

(65) Prior Publication Data

US 2025/0359671 A1 Nov. 27, 2025

(51) Int. Cl.
*A47B 97/00* (2006.01)

(52) U.S. Cl.
CPC ..... *A47B 97/00* (2013.01); *A47B 2097/008* (2013.01)

(58) Field of Classification Search
CPC ..... A47B 97/00; A47B 2097/008
See application file for complete search history.

(56) References Cited

U.S. PATENT DOCUMENTS

| | | | | |
|---|---|---|---|---|
| 6,220,562 | B1 * | 4/2001 | Konkle | A47B 97/00 248/500 |
| D512,903 | S | 12/2005 | Gallien | |
| 7,185,871 | B2 * | 3/2007 | Orozco | E02D 27/42 248/500 |
| 9,709,216 | B2 * | 7/2017 | Zing | F16B 9/05 |
| D905,537 | S | 12/2020 | Marsden | |
| 10,912,384 | B2 | 2/2021 | Lager et al. | |
| 11,060,330 | B2 * | 7/2021 | Marsden | E05C 17/52 |
| 11,596,231 | B2 * | 3/2023 | Lager | A44B 11/00 |
| 2013/0087675 | A1 * | 4/2013 | Miller | A47B 97/00 248/499 |
| 2014/0047693 | A1 * | 2/2014 | Cassidy | F16M 13/02 29/428 |

(Continued)

FOREIGN PATENT DOCUMENTS

| | | | | |
|---|---|---|---|---|
| EP | 3888497 | A1 * | 10/2021 | A47B 91/08 |

OTHER PUBLICATIONS

Mount-it! Furniture anti-tip anchor sold on amazon dated Mar. 5, 2018, https://www.amazon.ae/Mount-Furniture-Anti-Tip-Anchor-Earthquake/dp/B0716M45S2?th=1 (Year: 2018).*

(Continued)

*Primary Examiner* — Terrell L McKinnon
*Assistant Examiner* — Ding Y Tan
(74) *Attorney, Agent, or Firm* — Yorgos D. Marinakis

(57) ABSTRACT

An anti-tip system for furniture, comprising: a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway; a first bracket plate for fastening the first tube to the wall; a second tube for mounting on a piece of furniture, the second tube having a second tubular passageway therethrough with a second circular opening having a first opening diameter, the second tube further comprising at least one screw penetrating through a second tube wall for securing the elongate tubular flexible member in the second tubular passageway; a second bracket plate for fastening the second tube to the piece of furniture; and the elongate tubular flexible member.

10 Claims, 26 Drawing Sheets

(56) References Cited

U.S. PATENT DOCUMENTS

| | | | | |
|---|---|---|---|---|
| 2019/0150617 | A1* | 5/2019 | Lager | A44B 11/00 |
| 2020/0383476 | A1* | 12/2020 | Marsden | A47B 97/00 |
| 2021/0186216 | A1* | 6/2021 | Stravitz | A47B 97/00 |

OTHER PUBLICATIONS

Augsun furniture anchors with straps sold on amazon.com, first available dated Sep. 26, 2023 https://www.amazon.com/AUGSUN-Furniture-Proofing-Self-Adhesive-Bookcase/dp/B0CJT94RD5 (Year: 2023).*

"Best Answers for how to anchor furniture to wall for safety and stability in 2023" online posting at q-furniture.com https://q-furniture.com/how-to-anchor-furniture-to-wall-in-2023/ (Year: 2023).*

* cited by examiner

ANTI-TIP SYSTEM FOR FURNITURE

CROSS-REFERENCE TO RELATED APPLICATIONS

None.

STATEMENTS REGARDING FEDERALLY SPONSORED RESEARCH AND DEVELOPMENT

Not applicable.

BACKGROUND

The embodiments of the present invention satisfy the needs of having a better anti-tip system for preventing the tipping over of furniture.

Information relevant to attempts to address these problems can be found in U.S. Pat. Nos. 10,912,384, D905,537, and D512,903; which are not admitted to be prior art with respect to the present invention by its mention in this Background Section. However, it is desirable to have a better apparatus and/or method than is disclosed in the references.

U.S. Ser. No. 10/912,384 discloses and claims a furniture mounting bracket that must be secured to the top and back of the furniture. It secures the wall mount using proprietary mounting wires. It uses a quick release, and a strap rather than a rope or cord.

US D905,537 discloses and claims a mounting bracket.

US D512,903 discloses and claims a set of mounting brackets joined by a wire cable.

SUMMARY

The embodiments of the present invention are directed to a system that satisfies the needs set out in the Background section.

The embodiments of the present invention comprise an anti-tip system for furniture, comprising:

a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tube having a second tubular passageway therethrough with a second circular opening having a first opening diameter, the second tube further comprising at least one screw penetrating through a second tube wall for securing the elongate tubular flexible member in the second tubular passageway;

a second bracket plate for fastening the second tube to the piece of furniture; and the elongate tubular flexible member for securing the second tube to the first tube, comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageways.

Optionally, the elongate tubular flexible member is an elastic rope.

Optionally, the elongate tubular flexible member is an elastic cord.

Optionally, the first bracket plate comprises four tabs, each tab comprising at least one hole for receiving a fastener for attaching the first bracket plate to the wall.

Optionally, the fastener is a screw.

Optionally, the first bracket plate monolithically extends from the first tube.

Optionally, the first bracket plate and the first tube are injection molded.

Optionally, the first bracket plate is at least 3 mm thick.

Optionally, the second bracket plate comprises two tabs, each tab comprising at least one hole for receiving a fastener for attaching the first bracket plate to the wall.

Optionally, the fastener is a screw.

Optionally, the second bracket plate monolithically extends from the second tube.

Optionally, the second bracket plate and the second tube are injection molded.

Optionally, the second bracket plate is at least 3 mm thick.

Optionally, a distal end of the first tube comprises a side notch for securing the elongate tubular flexible member.

Optionally, a distal end of the second tube comprises a side notch for further securing the elongate tubular flexible member.

Optionally, a proximal end of the first tube comprises a top notch for enabling egress of the elongate tubular flexible member from a top of the first tube.

Optionally, a proximal end of the second tube comprises a top notch for enabling egress of the elongate tubular flexible member from a top of the second tube.

The advantages include the ability to install the wall mount with no knowledge of the location of wall studs: in such a case, fasteners can be used in all four tabs. If the stud location is known, then fasteners can be used in only two tabs. Moreover, the furniture mount is easily installed on furniture before the furniture ships to the consumer.

These and other advantages will become apparent as the embodiments of the invention are used.

BRIEF DESCRIPTION OF DRAWINGS

These and other features, aspects and advantages of the embodiments of the method will become better understood with reference to the following description, appended claim and accompanying drawings where:

REFERENCE NUMERALS FOR DRAWINGS

Figure 1:
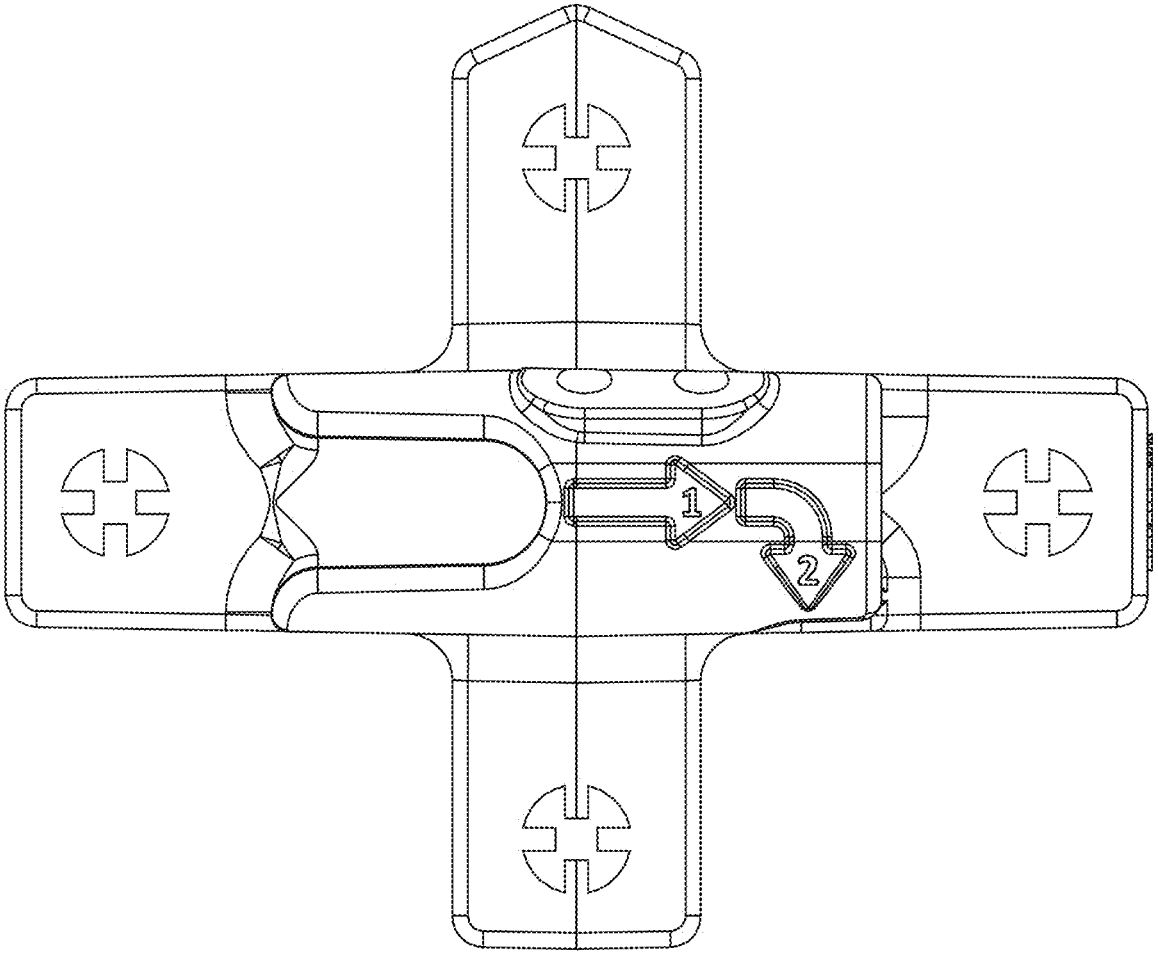
FIG. 1 shows a top plan view of an embodiment of the first tube and first bracket plate.
Figure 2:
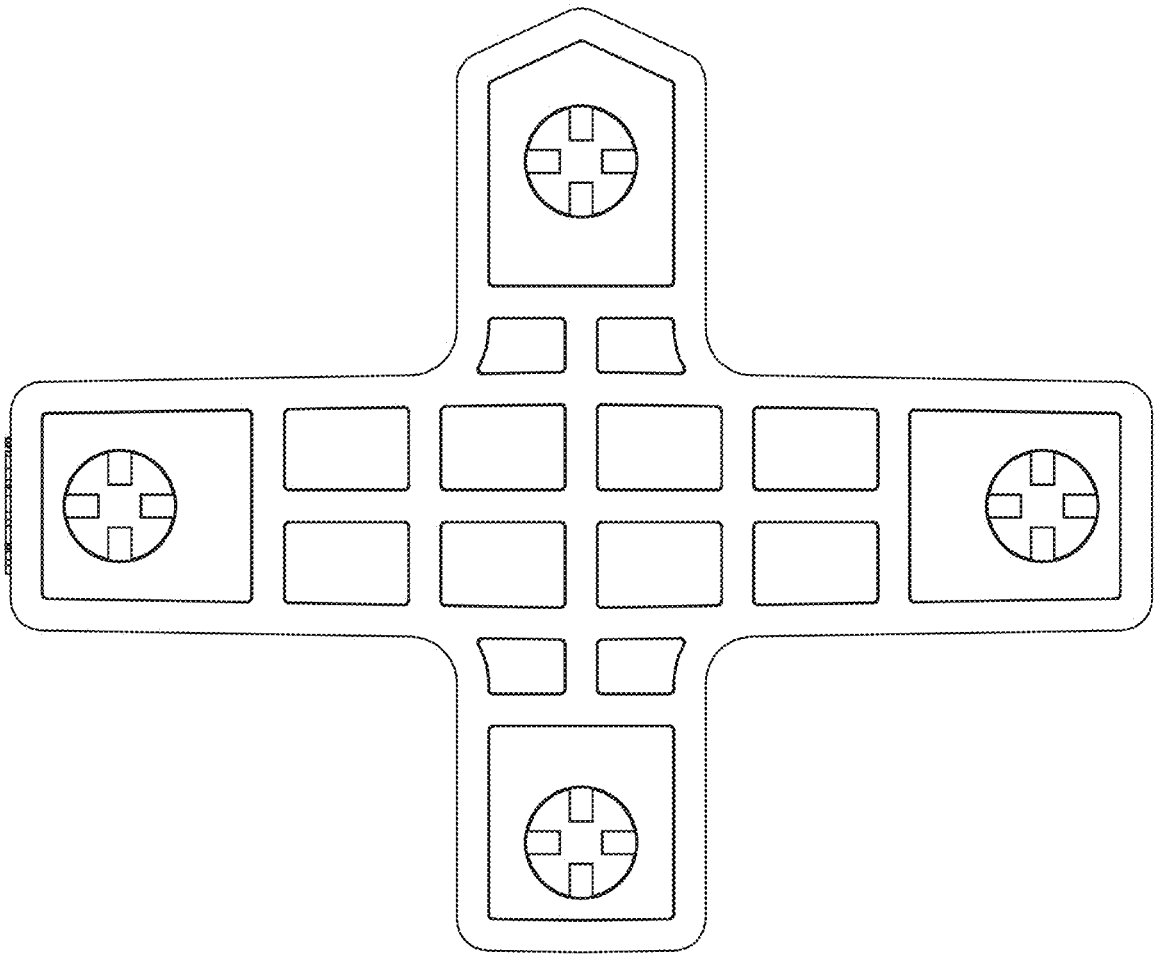
FIG. 2 shows bottom plan view of an embodiment of the first bracket plate.
Figure 3:
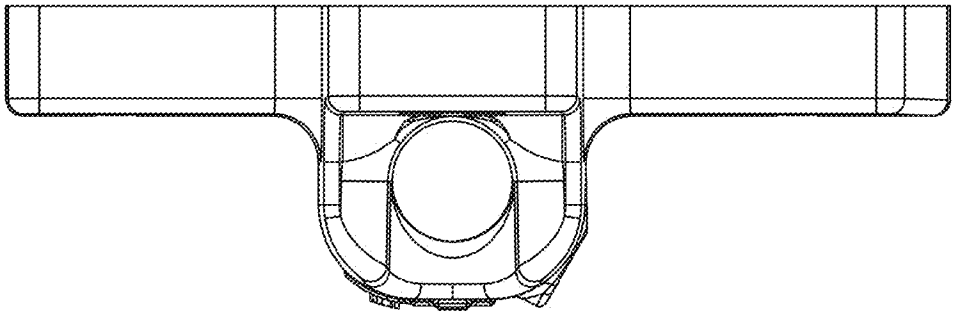
FIG. 3 shows a front elevation view of an embodiment of the first tube and first bracket plate.
Figure 4:
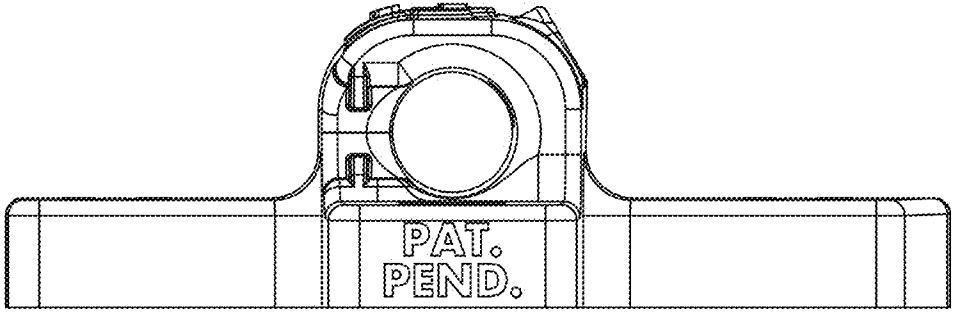
FIG. 4 shows a back elevation view of an embodiment of the first tube and first bracket plate.
Figure 5:
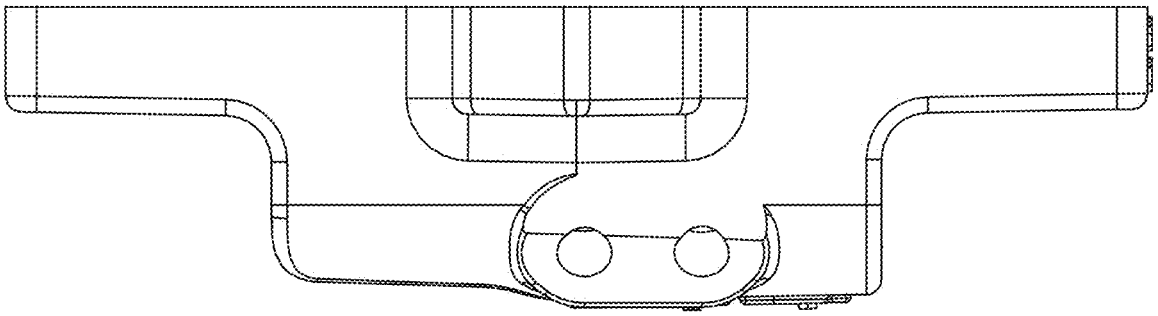
FIG. 5 shows a left elevation view of an embodiment of the first tube and first bracket plate.
Figure 6:
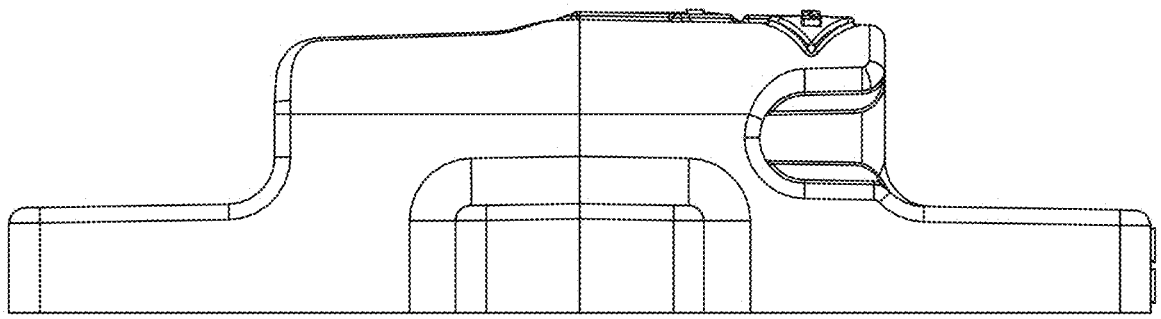
FIG. 6 shows a right elevation view of an embodiment of the first tube and first bracket plate.
Figure 7:
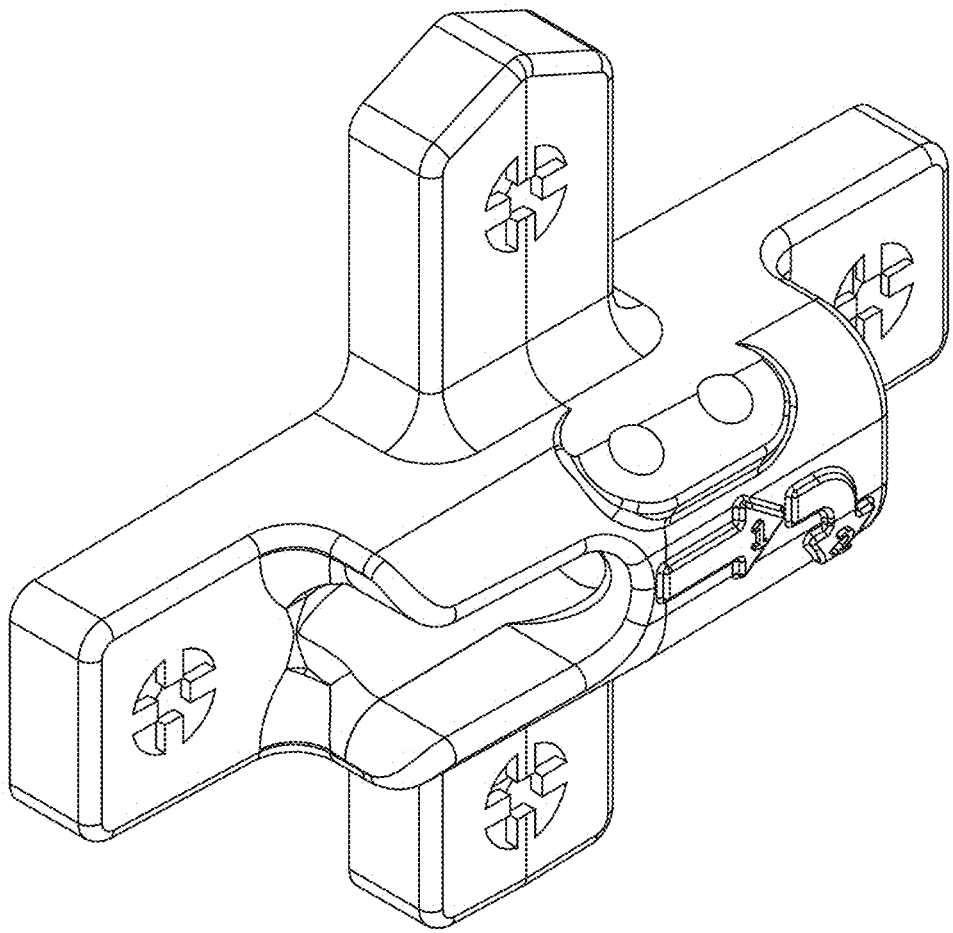
FIG. 7 shows a perspective view of an embodiment of the tops of the first tube and first bracket plate.
Figure 8:
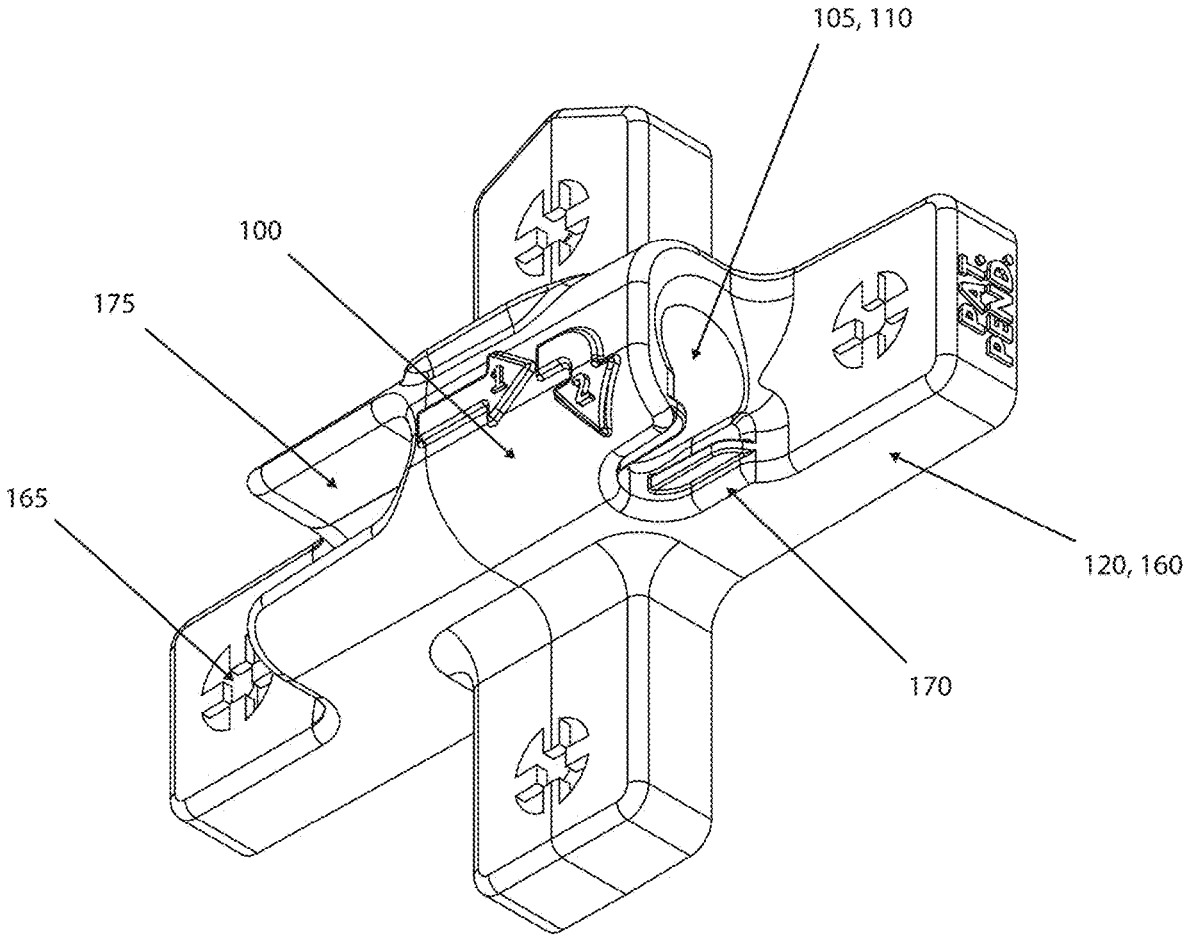
FIG. 8 shows a perspective view of an embodiment of the tops of the first tube and first bracket plate.
Figure 9:
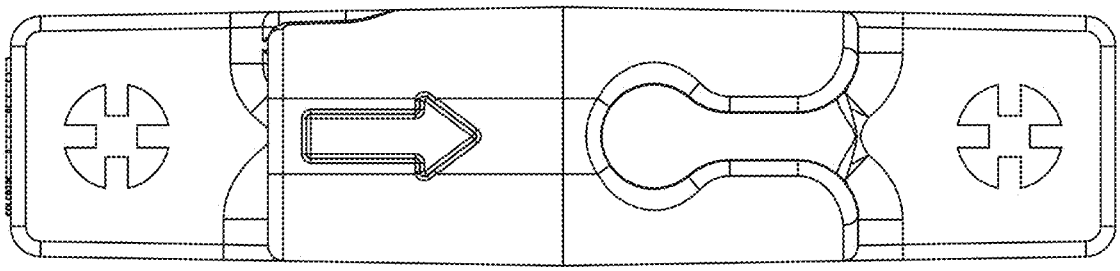
FIG. 9 shows a top plan view of an embodiment of the second tube and second bracket plate.
Figure 10:
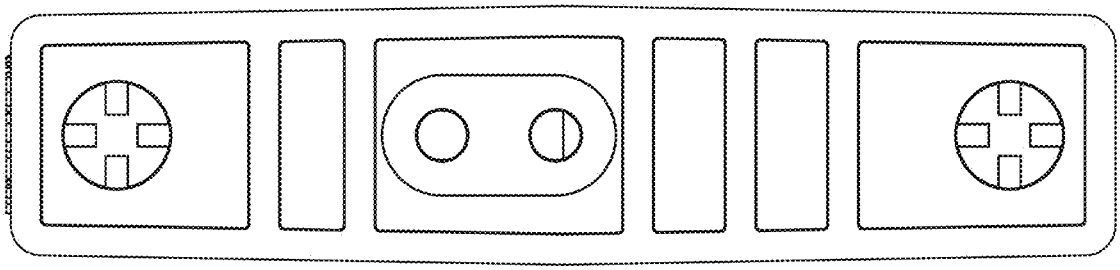
FIG. 10 shows bottom plan view of an embodiment of the second bracket plate.
Figure 11:
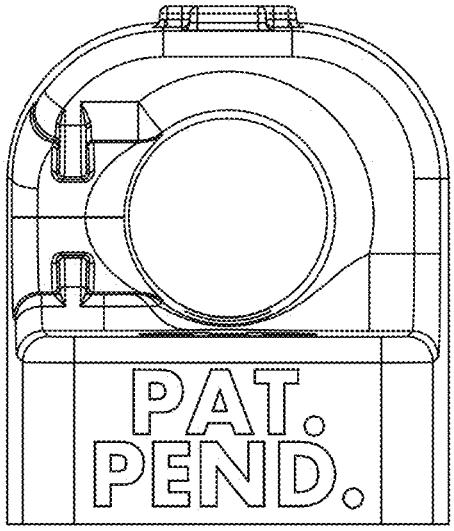
FIG. 11 shows a front elevation view of an embodiment of the second tube and second bracket plate.
Figure 12:
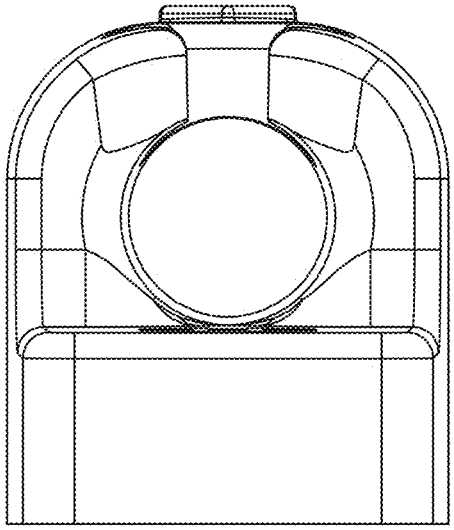
FIG. 12 shows a back elevation view of an embodiment of the second tube and second bracket plate.
Figure 13:
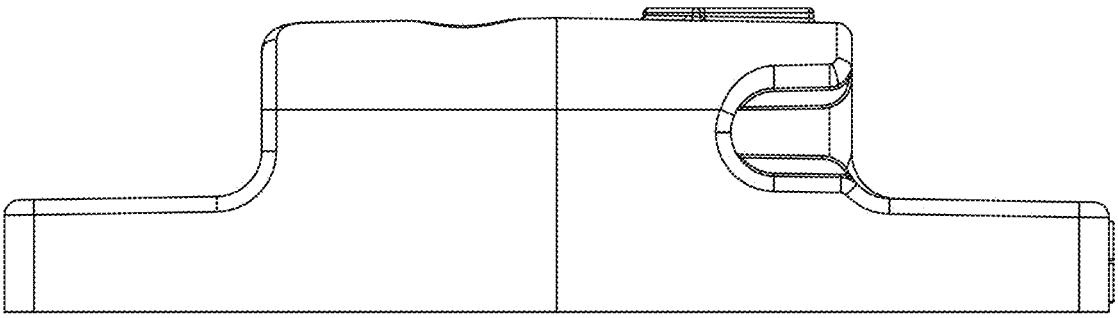
FIG. 13 shows a left elevation view of an embodiment of the second tube and second bracket plate.
Figure 14:
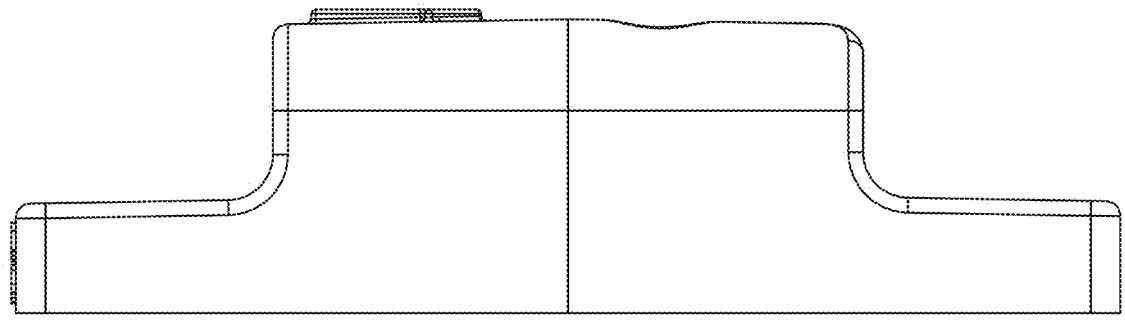
FIG. 14 shows a right elevation view of an embodiment of the second tube and second bracket plate.
Figure 15:
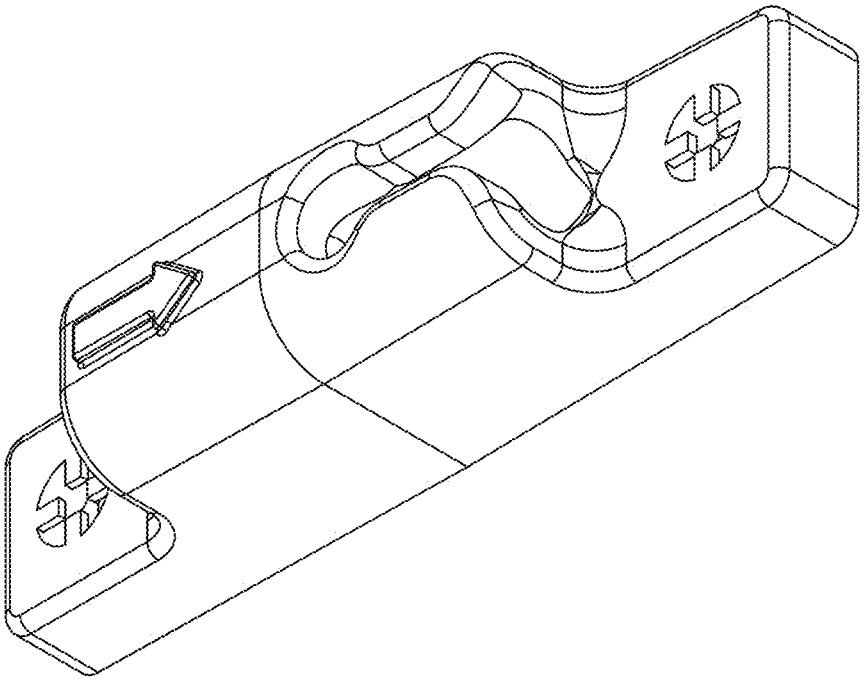
FIG. 15 shows a perspective view of an embodiment of the tops of the second tube and second bracket plate.
Figure 16:
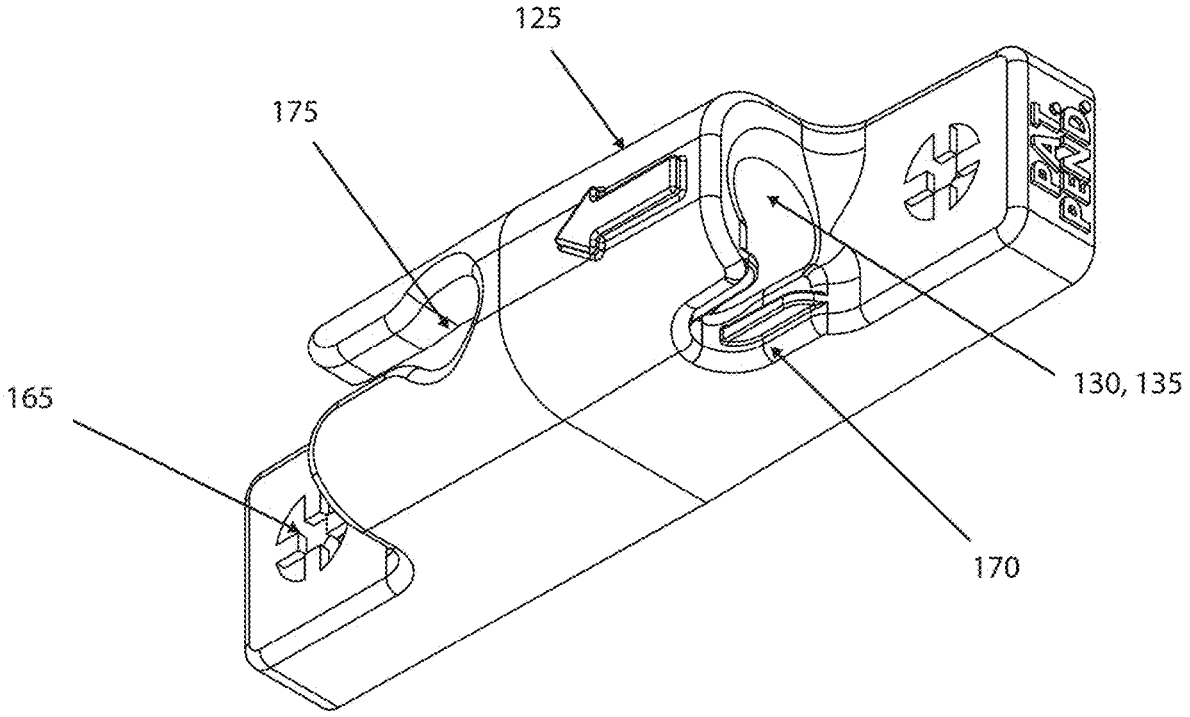
FIG. 16 shows a perspective view of an embodiment of the tops of the second tube and second bracket plate.
Figure 17:
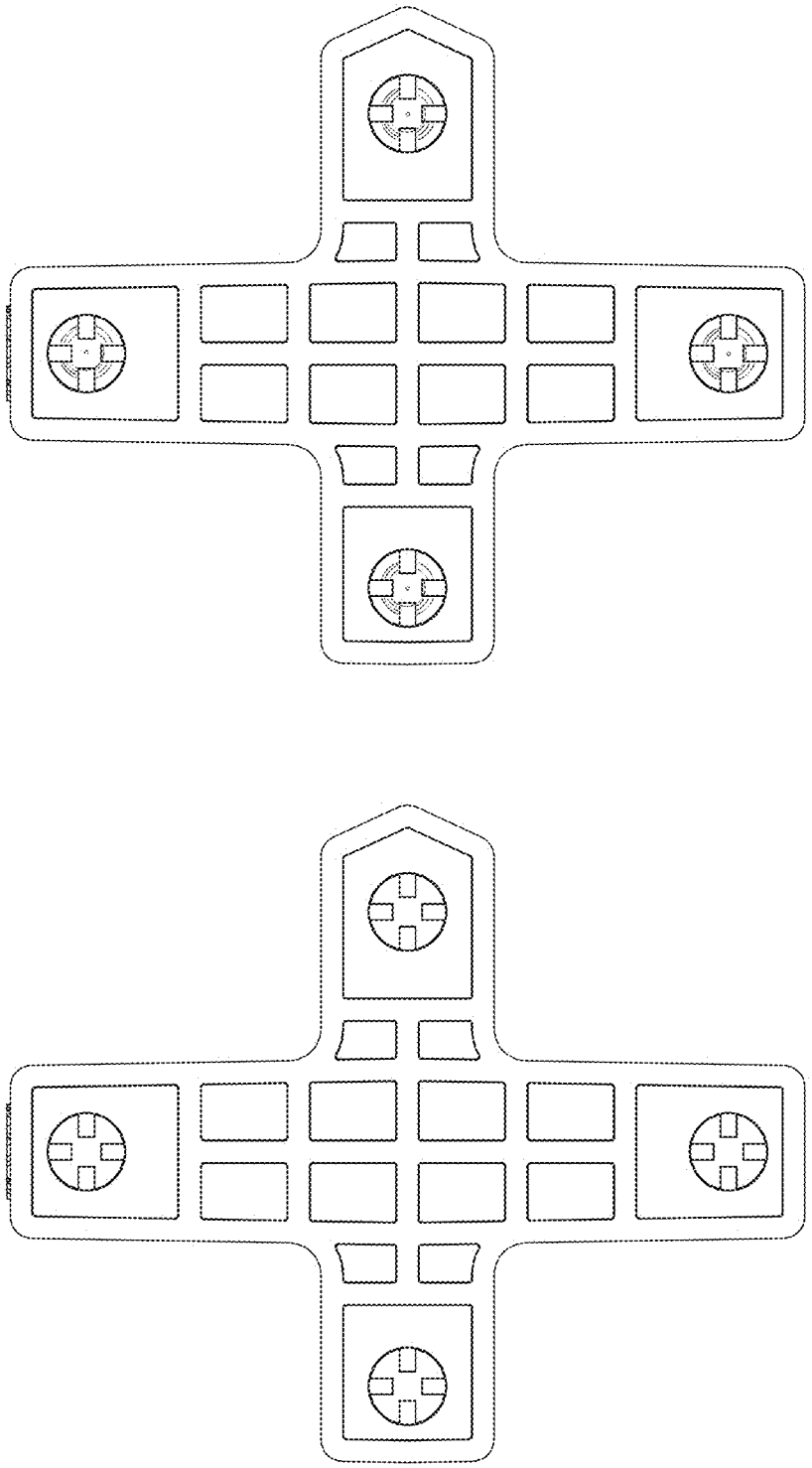
FIG. 17 shows bottom plan view of an embodiment of the first bracket plate showing where screws are placed in holes.
Figure 18:
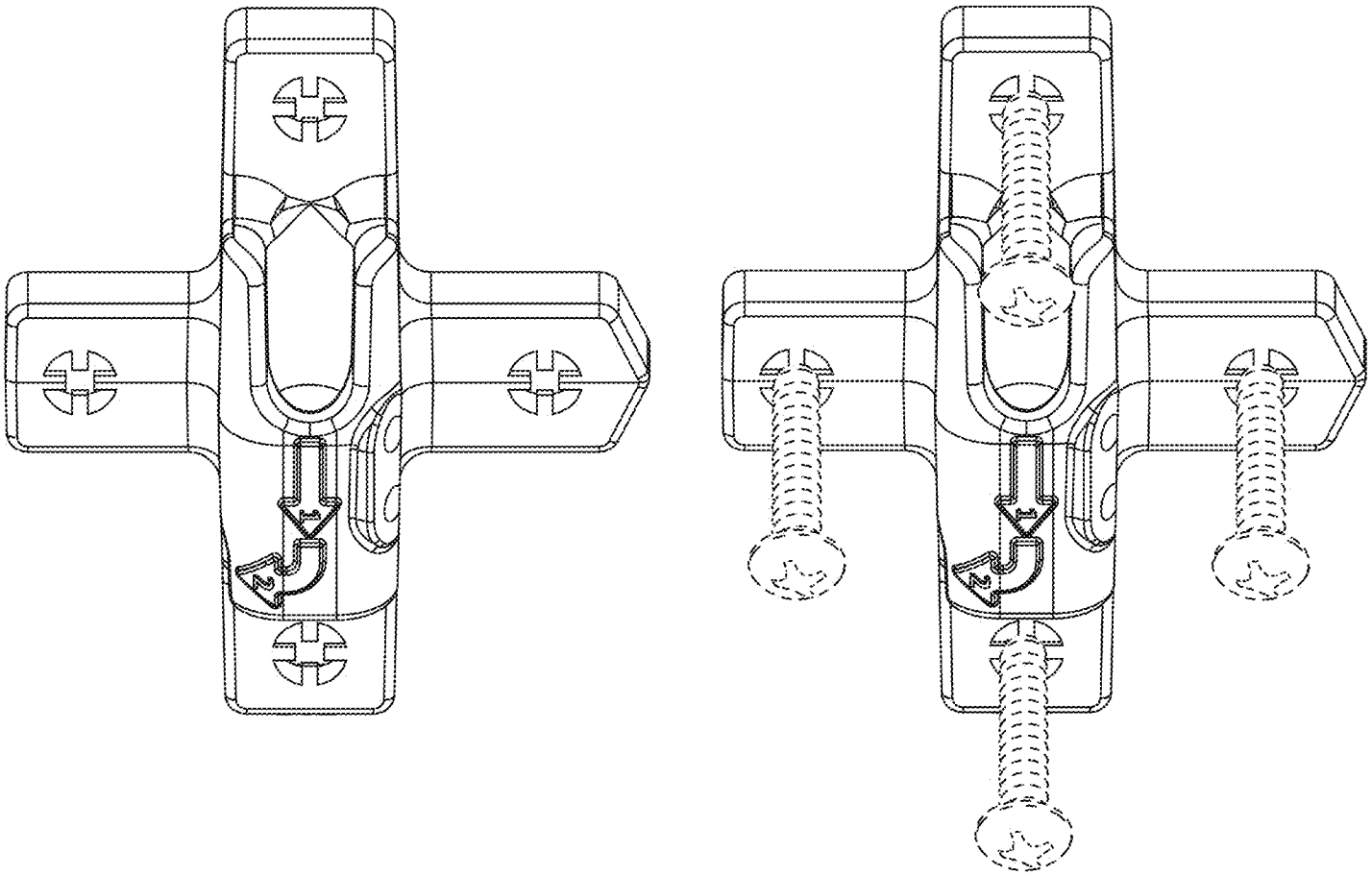
FIG. 18 shows a perspective view of an embodiment of the tops of the first tube and first bracket plate where screws are placed in holes in the tabs for securing the first tube and first bracket plate to a wall.
Figure 19:
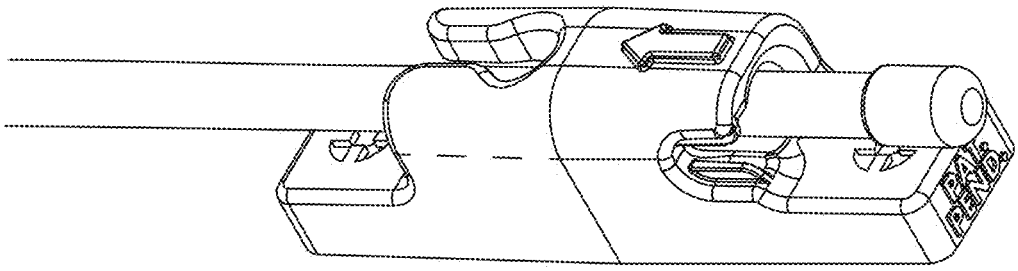
FIG. 19 shows a perspective view of an embodiment of the tops of the second tube and second bracket plate where the elongate tubular flexible member is placed in the second tubular passageway.
Figure 20:
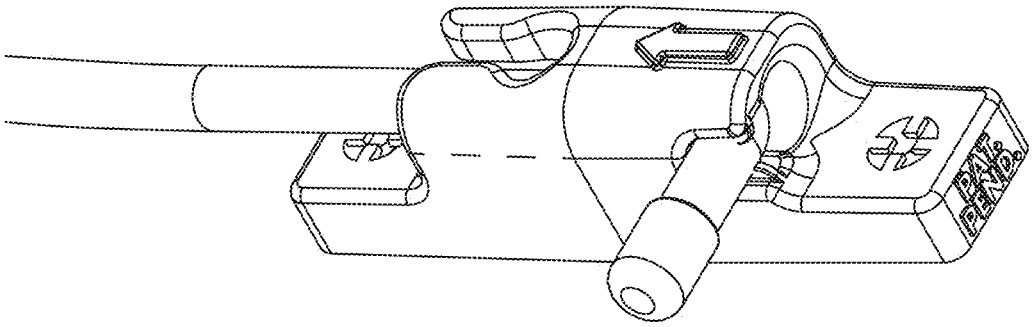
FIG. 20 shows a perspective view of an embodiment of the tops of the second tube and second bracket plate where the elongate tubular flexible member is placed in the second tubular passageway and one end is pulled into the second tube side notch.
Figure 21:
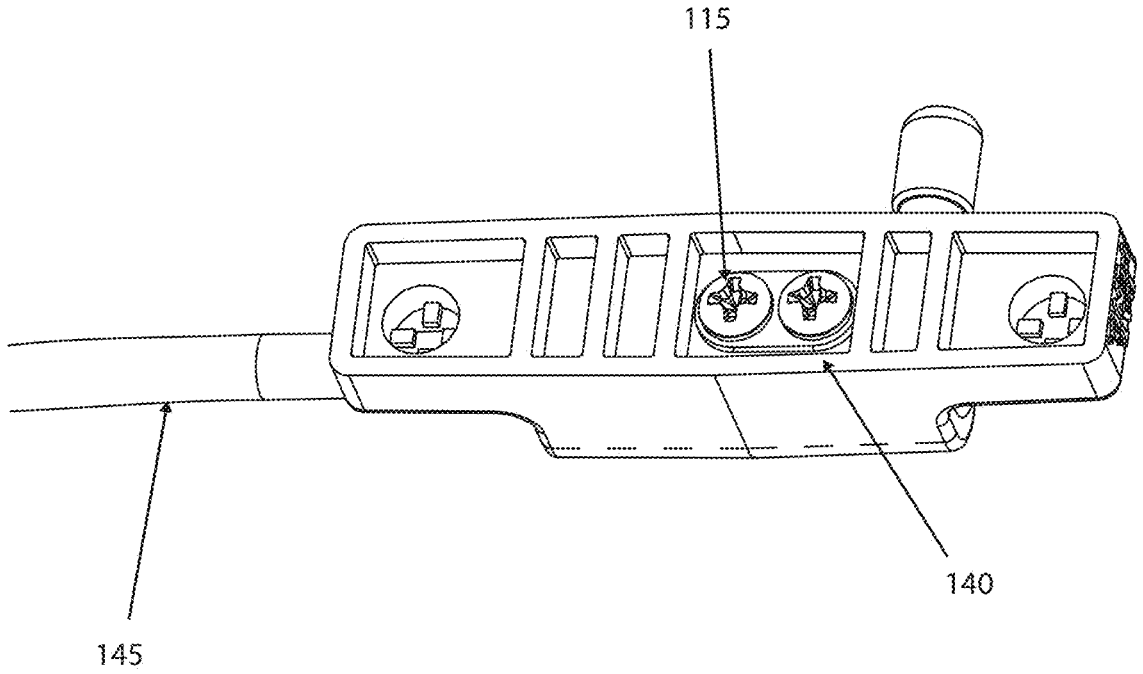
FIG. 21 shows a perspective view of an embodiment of the bottoms of the second tube and second bracket plate where the elongate tubular flexible member is placed in the second tubular passageway and pulled into the second tube side notch, and further shows screws in the bottom of the second bracket plate for securing the elongate tubular flexible member in the second tubular passageway.
Figure 22:
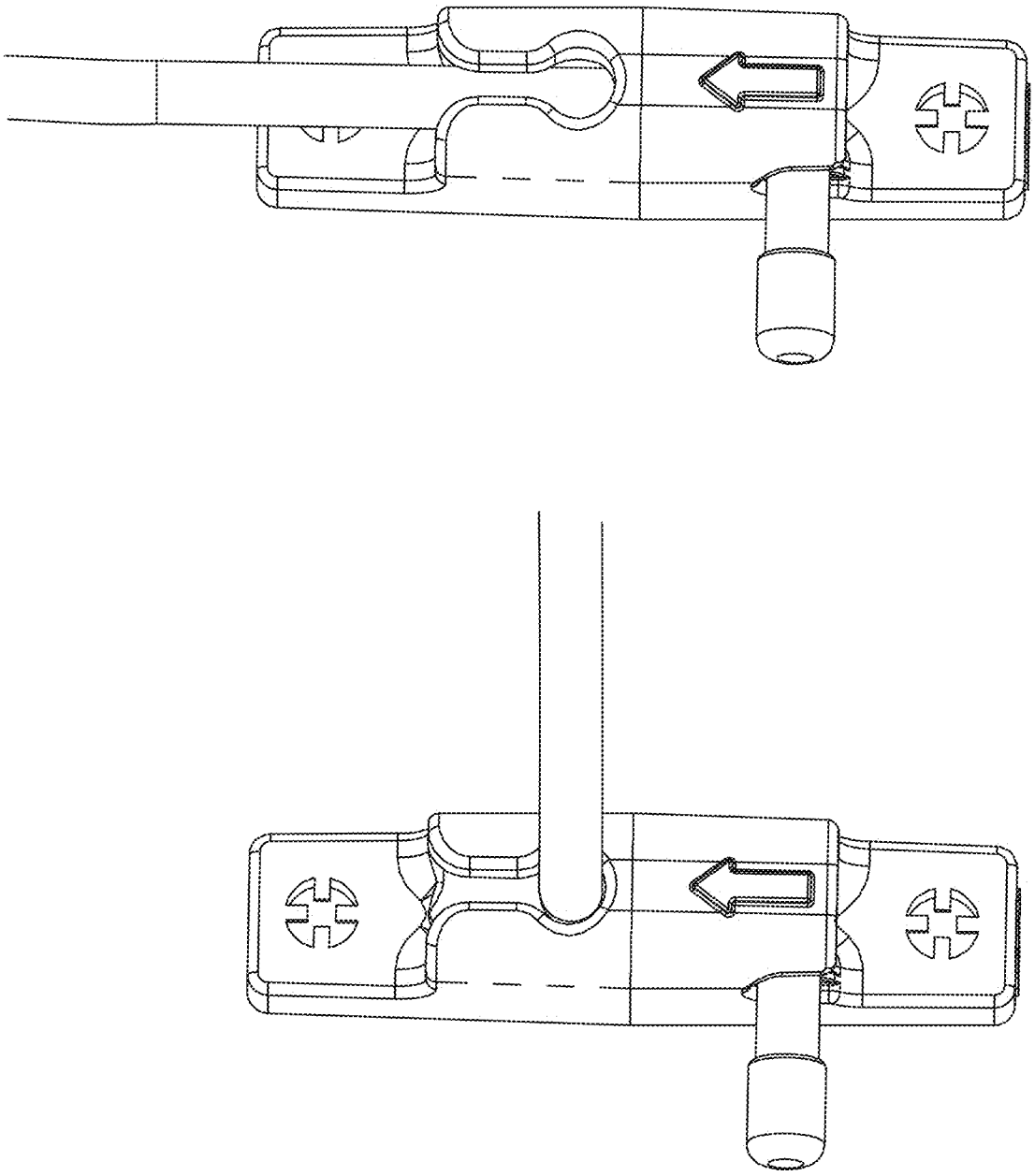
FIG. 22 shows a perspective view of an embodiment of the tops of the second tube and second bracket plate where the elongate tubular flexible member is placed in the second tubular passageway and one end is pulled into the second tube side notch and the other end is pulled out of the top notch.
Figure 23:
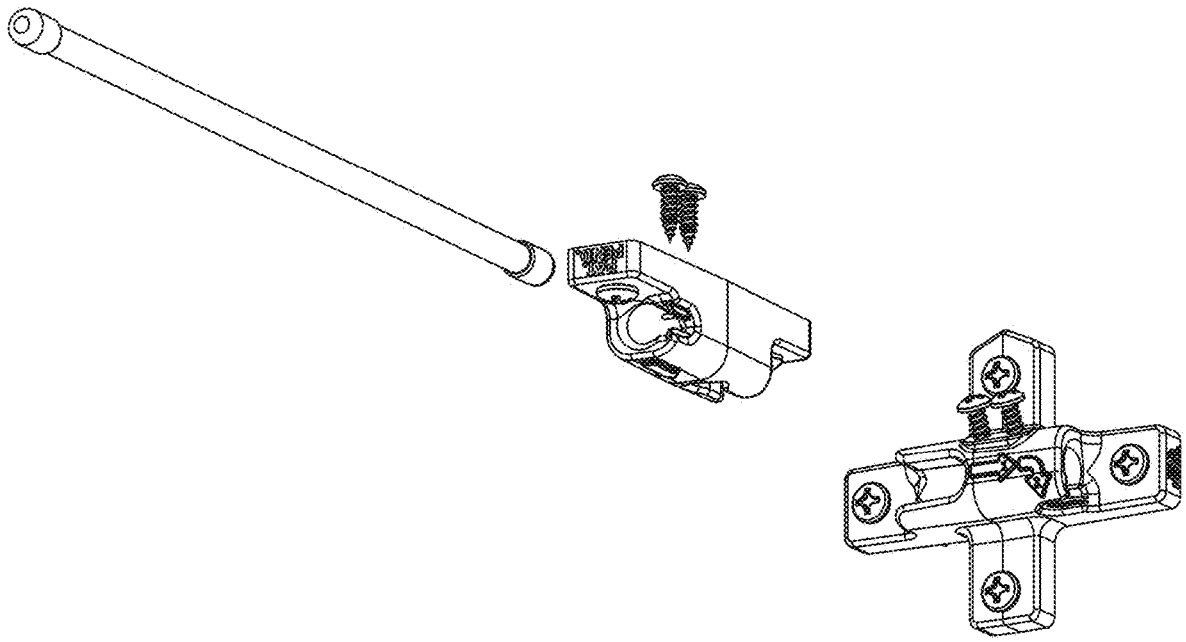
FIG. 23 shows an exploded view of an embodiment of the invention.
Figure 24:
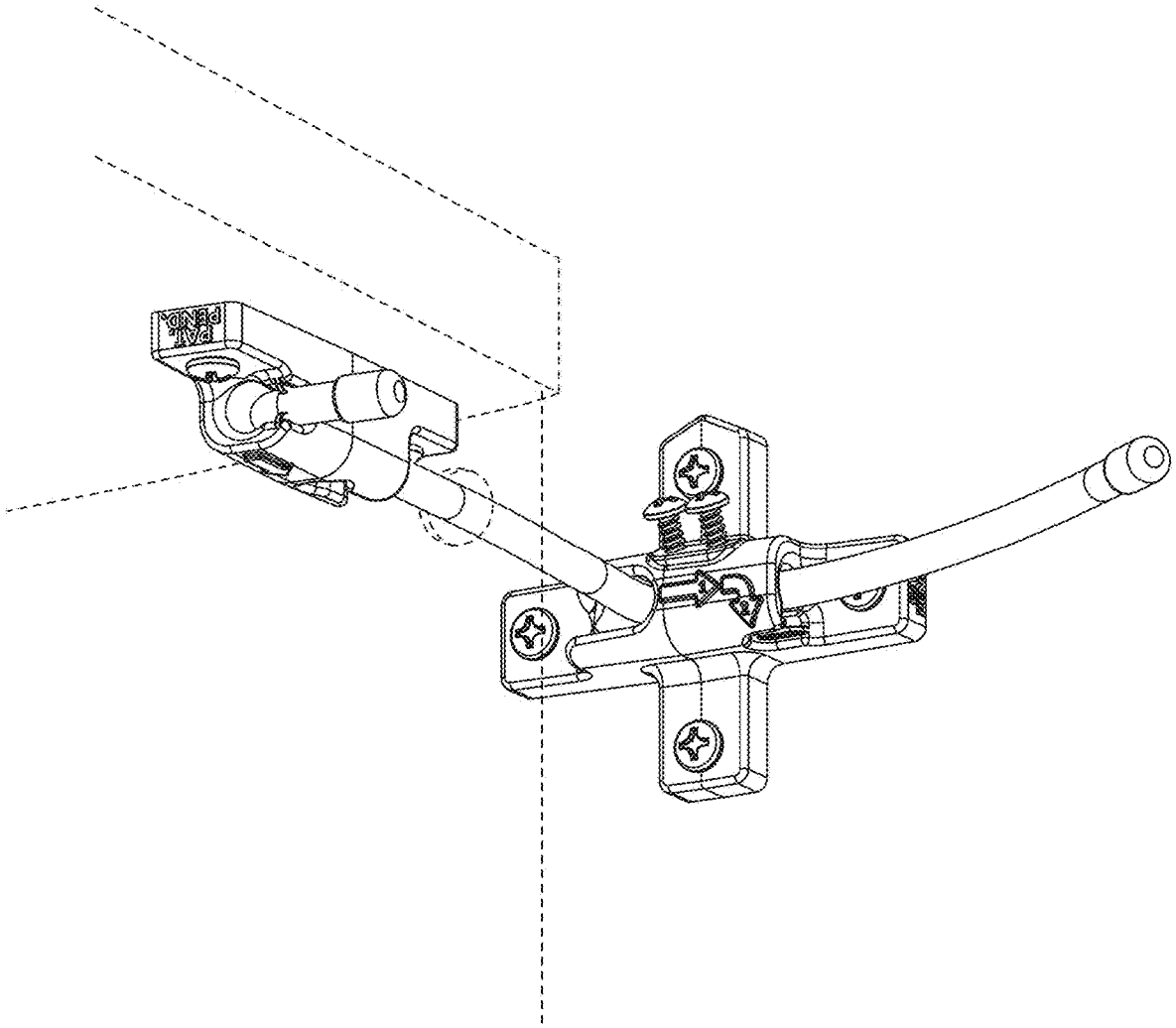
FIG. 24 shows of an example of a step in the use of an embodiment of the invention, wherein the elongate flexible member is pulled through the first passageway, wherein the first tube and first bracket are secured to a wall, and the second tube and second bracket are secured to a piece of furniture.
Figure 25:
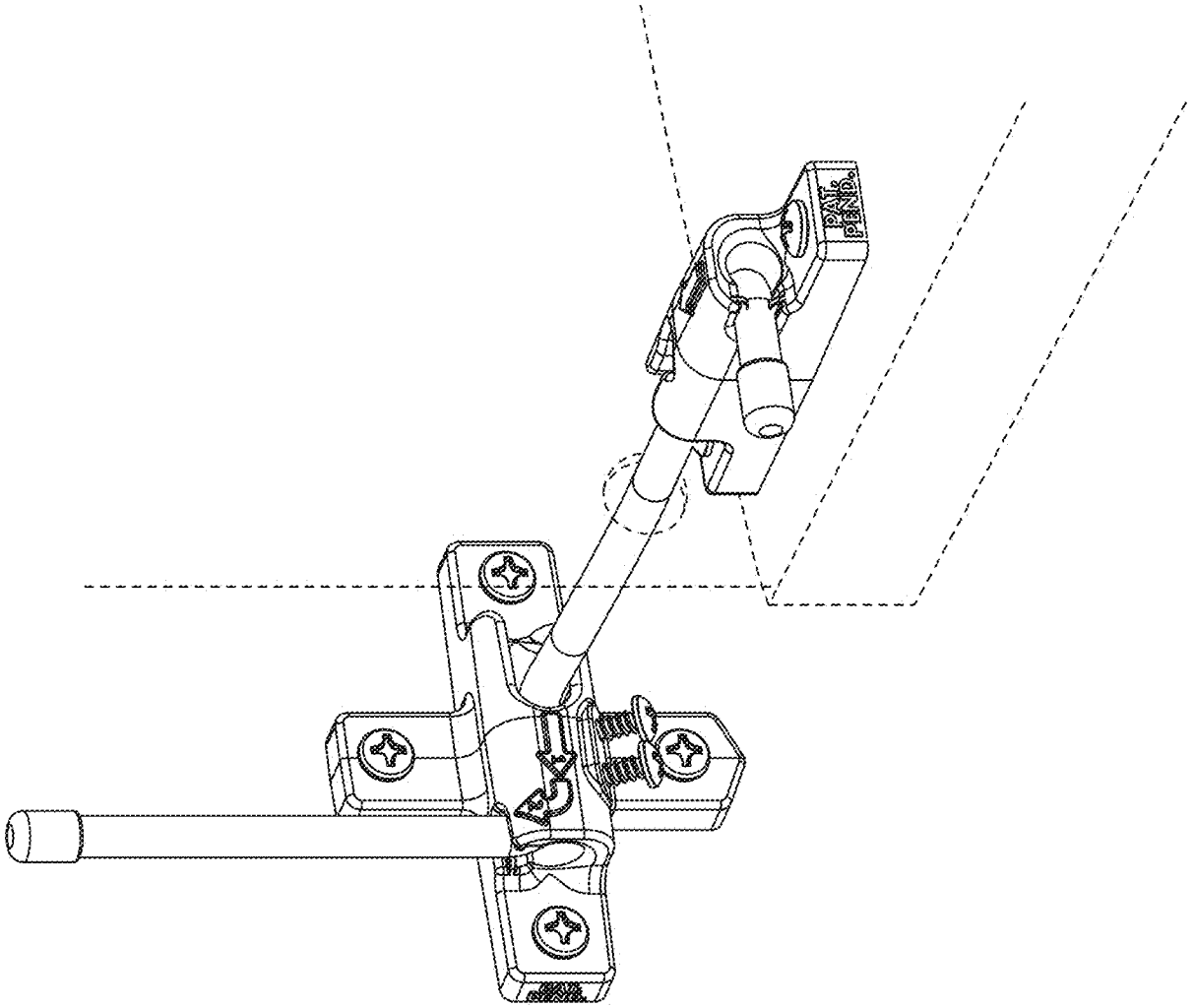
FIG. 25 shows an example of the next step in the use of an embodiment of the invention, wherein the elongate flexible member is pulled into the side notch in the first tube.
Figure 26:
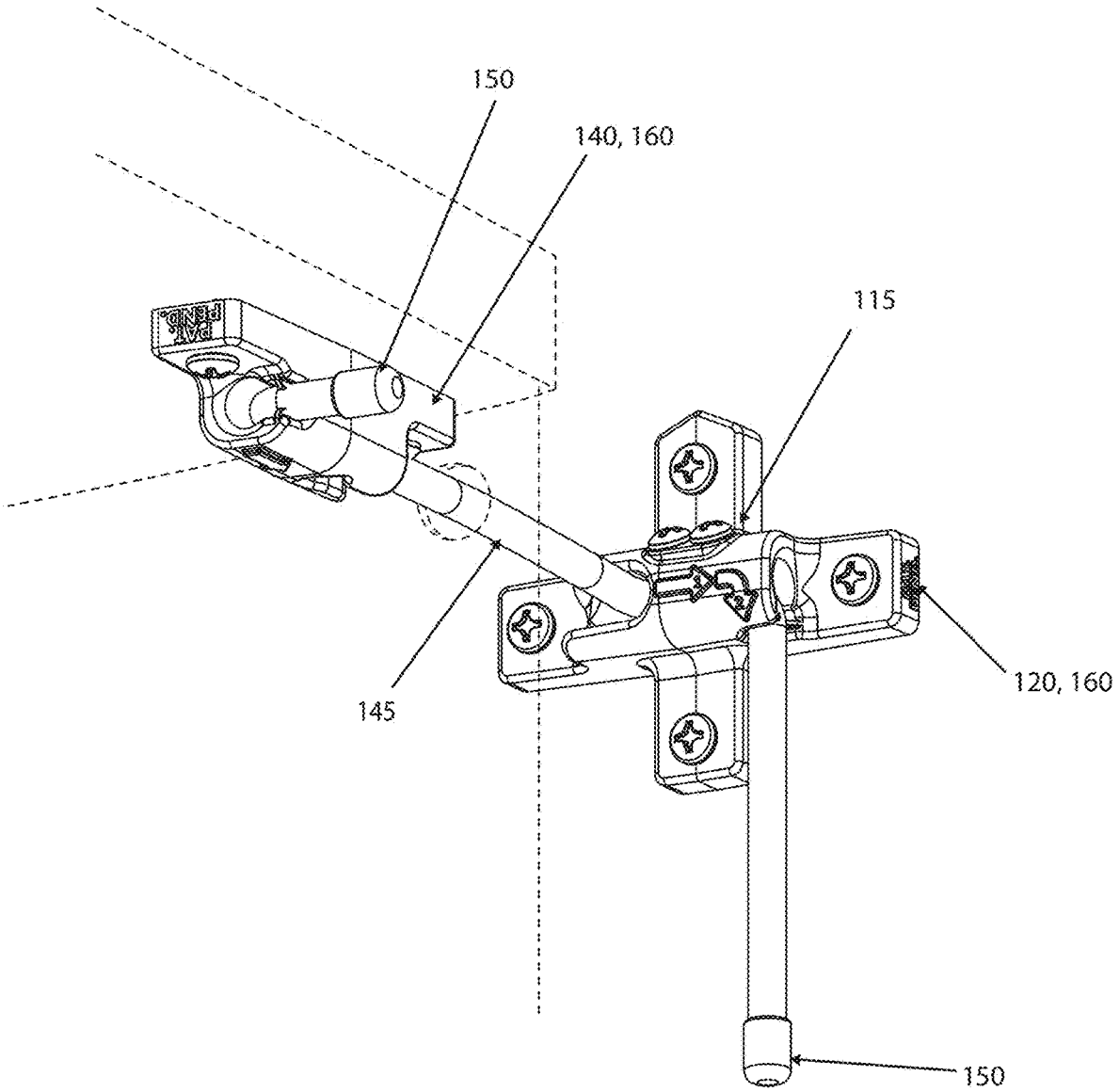
FIG. 26 shows an example of the final step in the use of an embodiment of the invention, wherein the screws for anchoring the elongate flexible member in the first tubular passageway are screwed down.

100 first tube
105 first tubular passageway
110 first circular opening
115 screw
120 first bracket plate
125 second tube
130 second tubular passageway
135 second circular opening
140 second bracket plate
145 elongate tubular flexible member
150 elongate tubular flexible member proximal end
155 elongate tubular flexible member distal end
160 tab
165 hole
170 side notch
175 top notch.

DESCRIPTION

Definitions

None.

DESCRIPTION OF THE PREFERRED EMBODIMENT AND BEST MODE

As shown in the figures, the preferred embodiment and best mode of the present invention comprise an anti-tip system for furniture, comprising:

- a first tube 100 for mounting on a wall, the first tube 100 having a first tubular passageway 105 therethrough with a first circular opening 110 having a first opening diameter, the first tube further comprising at least one screw 115 penetrating through a first tube 100 wall for securing an elongate tubular flexible member 145 in the first tubular passageway 105; a first bracket plate 120 for fastening the first tube 100 to the wall;
- a second tube 125 for mounting on a piece of furniture, the second tube 125 having a second tubular passageway 130 therethrough with a second circular opening 135 having a first opening diameter, the second tube 125 further comprising at least one screw 115 penetrating through a second tube 125 wall for securing the elongate tubular flexible member 145 in the second tubular passageway 130;
- a second bracket plate 140 for fastening the second tube 125 to the piece of furniture; and the elongate tubular flexible member 145 for securing the second tube 125 to the first tube 100, comprising an elongate tubular flexible member proximal end 150 and an elongate tubular flexible member distal end 155, wherein the elongate tubular flexible member 145 has an elongate tubular flexible member outer diameter smaller than the first opening diameter such that the elongate tubular flexible member proximal and distal ends 150, 155 can be threaded through the first and second circular openings 110, 135 and into the first and second tubular passageways 105, 130.

Preferably, the elongate tubular flexible member 145 is an elastic cord.

Preferably, the first bracket plate 120 comprises four tabs 160, each tab 160 comprising at least one hole 165 for receiving a fastener for attaching the first bracket plate 120 to the wall.

Preferably, the fastener is a screw 115.

Preferably, the first bracket plate 120 monolithically extends from the first tube 100.

Preferably, the first bracket plate 120 and the first tube 100 are injection molded.

Preferably, the first bracket plate 120 is at least 3 mm thick.

Preferably, the second bracket plate comprises two tabs 160, each tab 160 comprising at least one hole 165 for receiving a fastener for attaching the first bracket plate 120 to the wall.

Preferably, the fastener is a screw 115.

Preferably, the second bracket plate monolithically extends from the second tube 125.

Preferably, the second bracket plate 140 and the second tube 125 are injection molded.

Preferably, the second bracket plate 140 is at least 3 mm thick.

Preferably, a distal end of the first tube 100 comprises a side notch 170 for securing the elongate tubular flexible member 145.

Preferably, a distal end of the second tube 125 comprises a side notch 170 for further securing the elongate tubular flexible member 145.

Preferably, a proximal end of the first tube 100 comprises a top notch 175 for enabling egress of the elongate tubular flexible member 145 from a top of the first tube 100.

Preferably, a proximal end of the second tube 125 comprises a top notch 175 for enabling egress of the elongate tubular flexible member 145 from a top of the second tube 125.

To secure the piece of furniture to the wall, the user fastens the first bracket plate 120 to the wall using at least one screw 115 and the second bracket plate 140 to the piece of furniture using at least one screw 115. The user then inserts one end of the elastic cord through the first tube and secures it therein by tightening down the at least one screw 115 in the first tube 100 wall and also by pulling the elastic cord at a right angle through the side notch 170. The user then inserts the other end of the elastic cord through the second tube 125 and secures it therein by tightening down the at least one screw 115 in the second tube 125 wall and also by pulling the elastic cord at a right angle through the side notch 170. Depending on the position of the first bracket plate 120 with respect to the second bracket plate 140, the user might also position the cord through the top notches 175.

Some advantages of the embodiments of the apparatus were previously enumerated in the Summary section. Every advantageous feature does not need to be incorporated into every embodiment of the apparatus and/or methods.

Although these versions of the invention have been described in considerable detail, other versions are possible. For example, embodiments can comprise combinations of the features described herein, such as combinations of the dependent claims. Therefore, the spirit and scope of the appended claims should not be limited to the description of the versions contained therein.

I claim:

1. An anti-tip system for furniture, comprising:

a first tube for mounting on a wall, the first tube having a first tubular pas sage way therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tube having a second tubular passageway therethrough with a second circular opening having a first opening diameter, the second tube further comprising at least one screw penetrating through a second tube wall for securing the elongate tubular flexible member in the second tubular passageway;

a second bracket plate for fastening the second tube to the piece of furniture; and the elongate tubular flexible member for securing the second tube to the first tube comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageways, wherein the first bracket plate monolithically extends from the first tube.

2. The anti-tip system for furniture of claim 1, wherein the first bracket plate and the first tube are injection molded.

3. The anti-tip system for furniture of claim 2, wherein the first bracket plate is at least 3 mm thick.

4. An anti-tip system for furniture, comprising:

a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tube having a second tubular passageway therethrough with a second circular opening having a first opening diameter the second tube further comprising at least one screw penetrating through a second tube wall for securing the elongate tubular flexible member in the second tubular passageway;

a second bracket plate for fastening the second tube to the piece of furniture; and the elongate tubular flexible member for securing the second tube to the first tube, comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageways, wherein the second bracket plate monolithically extends from the second tube.

5. The anti-tip system for furniture of claim 4, wherein the second bracket plate and the second tube are injection molded.

6. The anti-tip system for furniture of claim 5, wherein the second bracket plate is at least 3 mm thick.

7. An anti-tip system for furniture, comprising:

a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tu having a second tubular passageway therethrough with a second circular opening having a first opening diameter, the second tube further comprising at least one screw penetrating through a second tube wall for securing the elongate tubular flexible member in the second tubular passageway;

a second bracket plate for fastening the second tube to the piece of furniture; and the elongate tubular flexible member for securing the second tube to the first tube, comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageways, wherein a distal end of the first tube comprises a side notch for securing the elongate tubular flexible member.

8. An anti-tip system for furniture, comprising:

a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tube having a second tubular passageway therethrough with a second circular opening having a first opening diameter the second tube further comprising at least one screw penetrating through a second tube wall for securing the elongate tubular flexible member in the second tubular passageway;

a second bracket plate for fastening the second tube to the piece of furniture; and the elongate tubular flexible member for securing the second tube to the first tube, comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageway, wherein a distal end of the second tube comprises a side notch for further securing the elongate tubular flexible member.

9. An anti-tip system for furniture, comprising:

a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tube having a second tubular passageway therethrough with a second circular opening having a first opening diameter, the second tube further comprising at least one screw penetrating through a second tube wall for securing the elongate tubular flexible member in the second tubular passageway;

a second bracket plate for fastening the seco tub the piece of furniture; and the elongate tubular flexible member for securing the second tube to the first tube comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageways, wherein a proximal end of the first tube comprises a top notch for enabling egress of the elongate tubular flexible member from a top of the first tube.

10. An anti-tip system for furniture, comprising:

a first tube for mounting on a wall, the first tube having a first tubular passageway therethrough with a first circular opening having a first opening diameter, the first tube further comprising at least one screw penetrating through a first tube wall for securing an elongate tubular flexible member in the first tubular passageway;

a first bracket plate for fastening the first tube to the wall;

a second tube for mounting on a piece of furniture, the second tube having a second tubular passageway therethrough with a second circular opening having a first opening diameter, the second tube further comprising at least one screw penetrating through a second tube wall for securing the elongate tubular flexible member in the second tubular passageway;

a second bracket plate for fastening the second tube to the piece of furniture; and the elongate tubular flexible member for securing the second tube to the first tube, comprising an elongate tubular flexible member proximal end and an elongate tubular flexible member distal end, wherein the elongate tubular flexible member has an elongate tubular flexible member outer diameter smaller than the first opening diameter such that the elongate tubular flexible member proximal and distal ends can be threaded through the first and second circular openings and into the first and second tubular passageways, wherein a proximal end of the second tube comprises a top notch for enabling egress of the elongate tubular flexible member from a top of the second tube.

* * * * *